US009555908B2

(12) United States Patent
Pecchenini et al.

(10) Patent No.: US 9,555,908 B2
(45) Date of Patent: Jan. 31, 2017

(54) SELF-PROPELLED WRAPPING MACHINE

(75) Inventors: Paolo Pecchenini, Casano Magnago (IT); Giuseppe Squarcialupi, Falciano (IT)

(73) Assignee: Robopac S.p.A. (SM)

( * ) Notice: Subject to any disclaimer, the term of this patent is extended or adjusted under 35 U.S.C. 154(b) by 537 days.

(21) Appl. No.: 14/113,700

(22) PCT Filed: May 8, 2012

(86) PCT No.: PCT/IB2012/052280
§ 371 (c)(1),
(2), (4) Date: Oct. 24, 2013

(87) PCT Pub. No.: WO2012/153265
PCT Pub. Date: Nov. 15, 2012

(65) Prior Publication Data

US 2014/0053502 A1 Feb. 27, 2014

(30) Foreign Application Priority Data

May 9, 2011 (IT) ..... MO2011A000106
May 12, 2011 (IT) ..... MO2011A000111

(51) Int. Cl.
*B65B 11/02* (2006.01)
*B65B 67/08* (2006.01)

(52) U.S. Cl.
CPC ..... *B65B 11/025* (2013.01); *B65B 67/08* (2013.01)

(58) Field of Classification Search
CPC ..... B65B 11/00; B65B 11/02; B65B 11/025; B65B 2011/00; B65B 2210/14; B65B 67/08
USPC ..... 53/556, 558, 218, 588, 589
See application file for complete search history.

(56) References Cited

U.S. PATENT DOCUMENTS 4,067,174 A * 1/1978 Goldstein ..... B65B 11/025 53/210
4,095,395 A * 6/1978 Goldstein ..... B65B 11/025 53/210
4,616,474 A * 10/1986 Morley ..... B65B 11/025 219/469

(Continued)

FOREIGN PATENT DOCUMENTS

CN 101797982 A * 8/2010
CN 201538439 U * 8/2010

(Continued)

*Primary Examiner* — Sameh Tawfik
*Assistant Examiner* — Eduardo R Ferrero
(74) *Attorney, Agent, or Firm* — Laubscher Spendlove & Laubscher, P.C.

(57) ABSTRACT

A self-propelled wrapping machine is movable around a product for wrapping the product with a film of synthetic plastic material and includes a self-propalled carriage provided with directional wheels and with a steering assembly for maneuvering the directional wheels. The wrapping machine further includes a spring acting on the steering assembly to exert a first torque and induce the steering assembly (11) to orient the directional wheels according to a prescribed work direction. The wrapping machine also includes a device that is drivable by the steering assembly to exert a further torque, opposite the first torque, on the steering assembly to lighten the assembly and thus facilitate an orienting maneuver of the directional wheels according to a further direction.

10 Claims, 17 Drawing Sheets

(56) References Cited

U.S. PATENT DOCUMENTS

| | | | | | |
|---|---|---|---|---|---|
| 4,631,898 | A * | 12/1986 | Brambilla | B65B 11/025 | 180/169 |
| 6,742,322 | B2 * | 6/2004 | Qicang | B65B 11/025 | 403/109.6 |
| 7,051,492 | B2 * | 5/2006 | Huson | B65B 67/085 | 53/390 |
| 2003/0046908 | A1 * | 3/2003 | Huson | B65B 67/085 | 53/588 |
| 2007/0169442 | A1 * | 7/2007 | Asioli | B65B 11/025 | 53/588 |
| 2010/0289778 | A1 * | 11/2010 | Felici | G05B 19/108 | 345/184 |
| 2012/0042615 | A1 * | 2/2012 | Roche | B65B 67/08 | 53/461 |
| 2013/0061558 | A1 * | 3/2013 | Klear | B65B 11/025 | 53/218 |

FOREIGN PATENT DOCUMENTS

| | | | | | |
|---|---|---|---|---|---|
| CN | 104369892 | A * | 2/2015 | | |
| EP | 1270418 | A1 * | 1/2003 | B65B 11/025 | |
| GB | 1487512 | A * | 10/1977 | B65B 11/025 | |
| WO | 2005110852 | A1 | 11/2005 | | |
| WO | WO 2005110852 | A1 * | 11/2005 | B65B 11/025 | |
| WO | WO 2009016464 | A1 * | 2/2009 | G05B 19/108 | |

* cited by examiner

SELF-PROPELLED WRAPPING MACHINE

This application is a §371 National Stage of PCT International Application No. PCT/IB2012/052280 filed May 8, 2012. PCT/IB2012/052280 claims priority to IT Application No. MO2011A000106 filed May 9, 2011 and IT Application No. MO2011A000111 filed May 12, 2011. The entire content of these applications are incorporated herein by reference.

BACKGROUND OF THE INVENTION

The invention relates to a self-propelled wrapping machine. In particular, the invention relates to a self-propelled wrapping machine, or robot, for wrapping products or groups of products that are palletized or arranged on a pallet or on several superimposed pallets with a film of cold stretchable synthetic plastic material.

Such wrapping machines are generally used for wrapping a product or group of products of non-standard dimensions, mainly in small production runs, and in cramped productive environments in which static wrapping machines cannot be used.

BRIEF DESCRIPTION OF THE PRIOR ART

Known self-propelled wrapping machines include a motorized self-propelled carriage including a supporting body and a guide body rotatably connected to the supporting body. The supporting body, provided with a pair of non-directional wheels, supports an upright on which a plastics film reel supplying unit is mounted that is provided with a film unwinding device.

The guide body includes a pair of directional wheels connected to, and maneuvered by, a steering assembly including a curved maneuvering bar provided at one end thereof with grasping handles.

In particular, the steering is movable between a lowered maneuvering position, in which an operator can maneuver the wrapping machine manually between the pallets and a raised work position, in which the wrapping machine is stationary or can rotate automatically around the pallet for wrapping the product or the groups of products.

The guide body is further provided with a mechanical feeler that enables the carriage to follow a profile of the palletized products to be wrapped.

More precisely, the mechanical feeler includes a rod, connected to the steering assembly, to an end of which a contact wheel is fixed that is arranged in use for contacting the profile of the palletized products to be wrapped.

The rod is further connected to the supporting body by a spring.

The spring acts on the rod such as to maintain the contact wheel pressed against the products during wrapping and to guide the directional wheels of the carriage according to a work direction.

In use, for wrapping the products placed on a pallet, an operator positions the steering assembly in the maneuvering position and places the carriage near the pallet.

Subsequently, the operator positions the steering assembly in the work position and activates the wrapping programme.

At this point, the carriage starts to rotate automatically around the pallet, following the profile of the pallet by way of the mechanical feeler.

The combination of the movement of the self propelling carriage around the pallet and of the vertical movement of the reel achieves helical wrapping of the products.

After wrapping has terminated, the operator repositions the steering assembly in the maneuvering position and directs the wrapping machine to another pallet of products to be wrapped.

A drawback of such wrapping machines is that they are heavy to be maneuvered manually by an operator.

In fact, for maneuvering such wrapping machines, the operator, after positioning the steering assembly in the maneuvering position, has to overcome a torque generated by the aforesaid spring on the steering assembly, this torque tending to maintain the steering assembly turned in the work direction.

In particular, the greater the torque, the harder the operator tries to turn the steering assembly with respect to the aforesaid direction.

SUMMARY OF THE INVENTION

An object of the invention is to improve self-propelled wrapping machines.

A further object is to provide a self-propelled wrapping machine that is easier to maneuver by an operator than are known wrapping machines.

Owing to the invention, it is possible to provide a self-propelled wrapping machine that is easier for an operator to maneuver than are known wrapping machines. In fact, the actuating device, by actuating on the maneuvering assembly in contrast with the elastic assembly, lightens the maneuvering assembly, making it easier for an operator to maneuver.

Owing to the invention, it is possible to provide a self-propelled wrapping machine that is easier for an operator to maneuver than are known wrapping machines. In fact, the driving device, by driving the spring in the non-operating configuration, enables the maneuvering assembly to be lightened, making the maneuvering assembly easier for the operator to maneuver.

BRIEF DESCRIPTION OF THE FIGURES

The invention can be better understood and implemented with reference to the attached drawings, which illustrate some embodiments thereof by way of non-limiting examples, in which.

DETAILED DESCRIPTION

Figure 1:
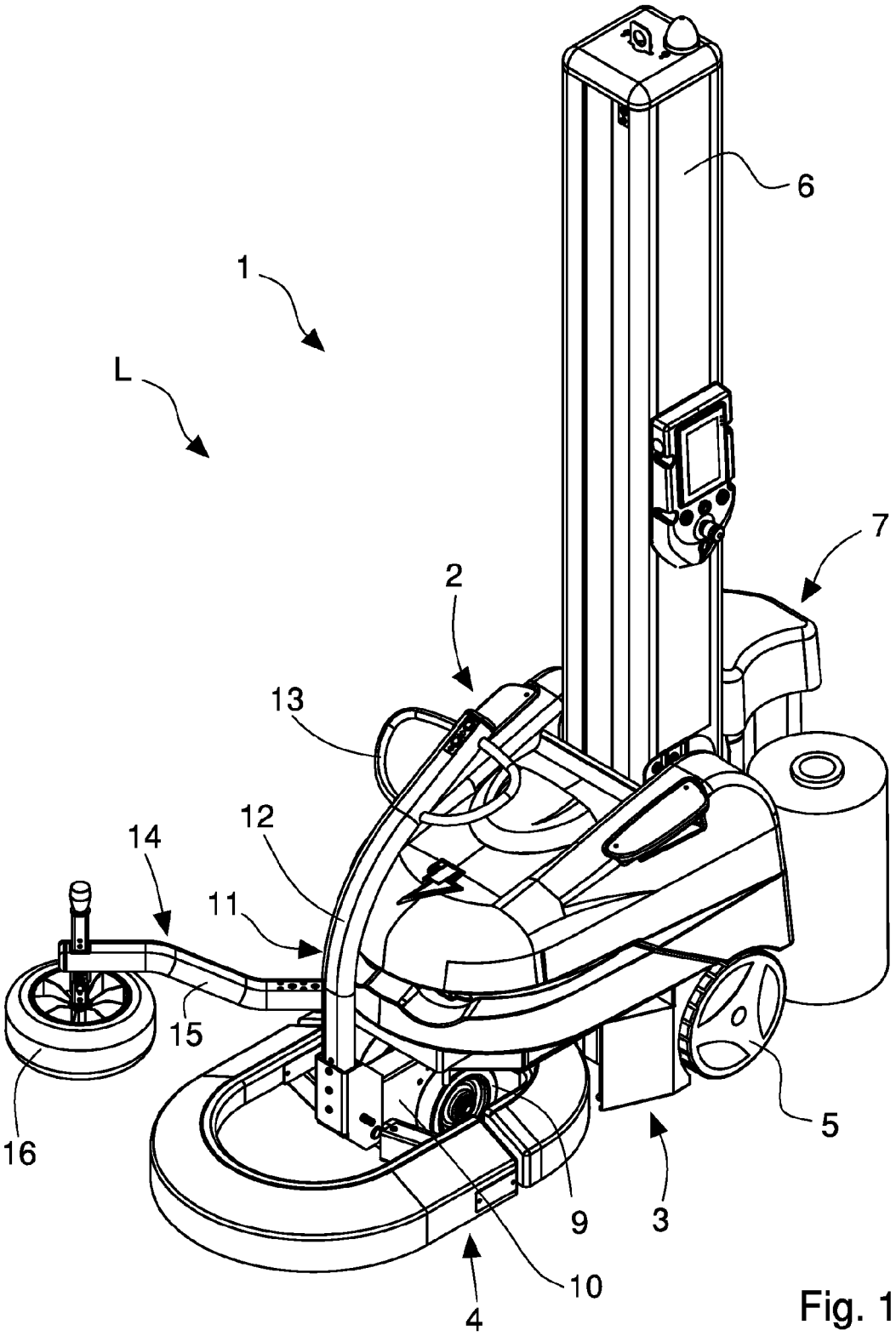
FIG. 1 is a perspective view of a self-propelled wrapping machine according to the invention.
Figure 2:
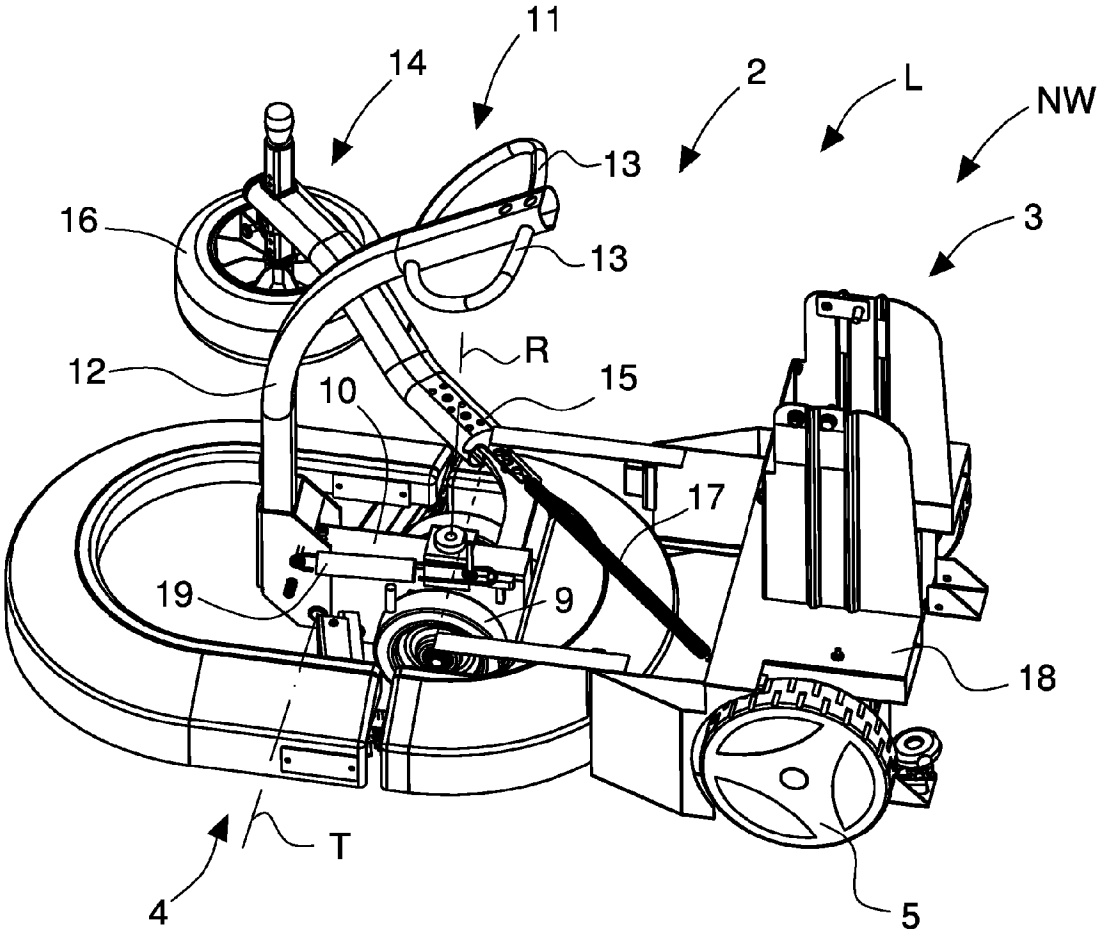
FIG. 2 is a perspective view of the machine in FIG. 1 with some details removed and showing a maneuvering assembly included in this machine in a first operating position.
Figure 3:
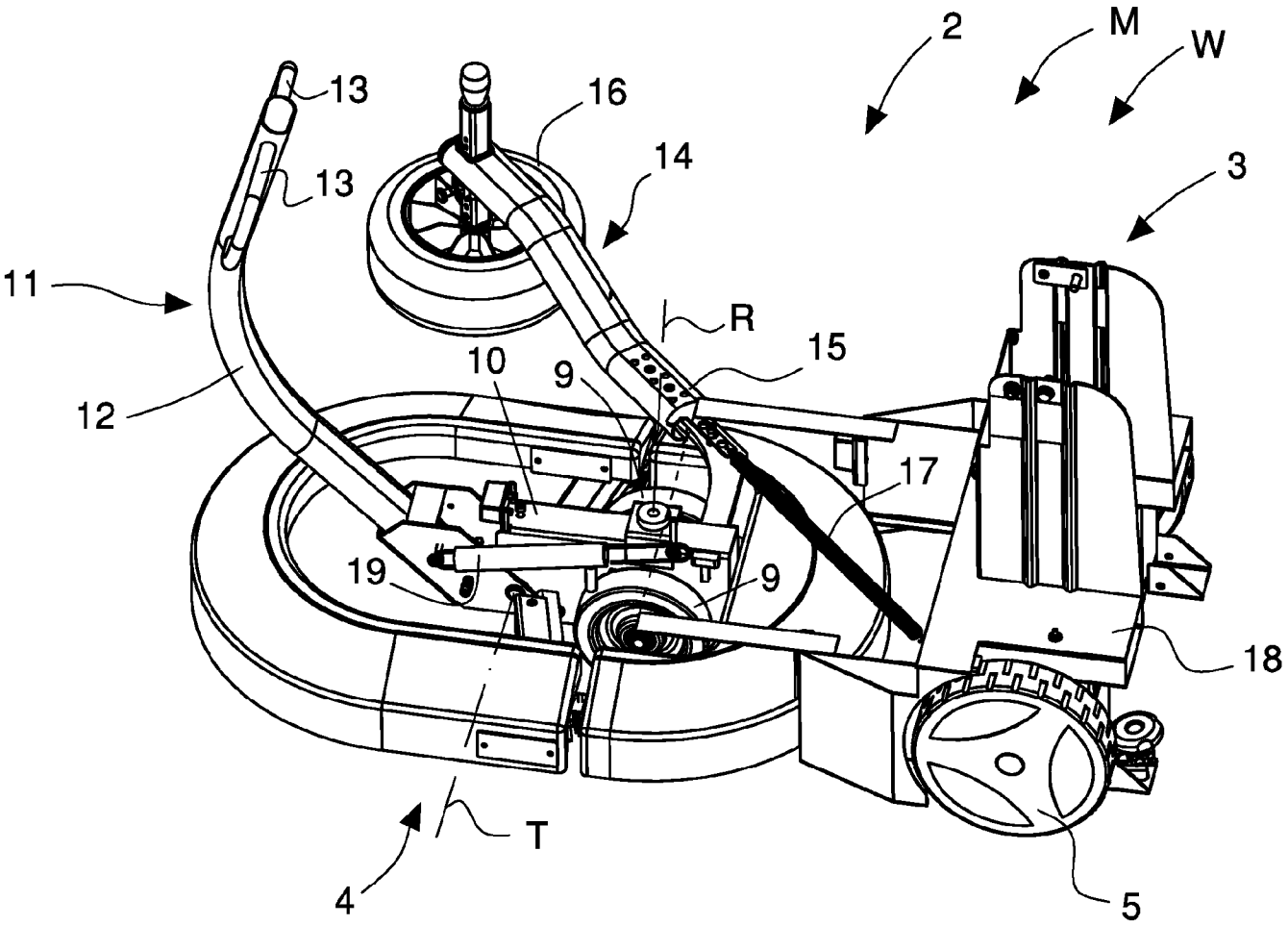
FIG. 3 is a perspective view of the machine in FIG. 1 with some details removed and showing the maneuvering assembly in a second operating position.

With reference to FIG. 1, there is shown a self-propelled wrapping machine 1, also known as a wrapping robot, for wrapping with a film of synthetic plastic material, for example a film of stretchable plastic material, a product or groups of products palletized or arranged on a bench or on a pallet or on several superimposed pallets. The wrapping machine 1 is generally used for wrapping a product or group of products of non-standard dimensions, mainly in small production runs, and in cramped production environments in which static wrapping machines cannot be used. The wrapping machine 1 includes a motorized self-propelled carriage 2.

The carriage 2 includes a supporting body 3 and a guide body 4 that is rotatably connected to the supporting body 3.

The supporting body 3, which is provided with a pair of non-directional wheels 5, supports an upright 6 on which a supply unit 7 of the reel of film is slidably mounted that is provided with an unwinding device, which is not shown, for unwinding the film.

The aforesaid guide body 4 includes a pair of directional wheels 9 steering around a substantially vertical rotation axis R (FIGS. 2, 3, 4, 6, 8, 10, 14, 16-18, 20, 22, 24, 26 and 28).

In particular, the directional wheels 9 are rotatably mounted onto a support 10 of the guide body 4 connected to and maneuvered by a steering assembly 11.

The steering assembly 11 includes a curved maneuvering bar 12 provided at one end thereof with grasping handles 13.

In particular, the steering assembly 11 is rotatably connected to the support 10 and is rotatable around a substantially horizontal axis T (FIGS. 2, 3, 8, 10, 12, 14, 16-18, 20, 22, 24, 26 and 28) between a lowered maneuvering position M (FIGS. 3, 6, 10, 14, 17, 20, 24, 28), in which an operator, who is not shown, can move the wrapping machine 1 manually between the pallets, and a raised work position L (FIGS. 1, 2, 4, 8, 12, 16, 18, 22, 26), in which the wrapping machine 1 is stationary or can rotate automatically, as will be explained below, around the pallet for wrapping the product or the groups of products.

The guide body 4 is further provided with a mechanical feeler 14 that enables the carriage 2 to follow a profile of the palletized products to be wrapped.

More precisely, the mechanical feeler 14 includes a rod 15 connected, by the support 10, to the steering assembly 11, to an end of which a contact wheel 16 is fixed that is arranged in use for contacting the profile of the palletized products to be wrapped.

The rod 15 is further connected to the supporting body 3 by a spring 17 (FIGS. 2, 3, 4, 6, 8, 10, 12, 14, 16-18, 20, 22, 24, 26 and 28).

In particular, the spring 17 has an end pivoted in a first point f1 of the rod 14 and a further end pivoted in a second point f2 of a frame 18, shown partially dashed, of the supporting body 3 (FIGS. 4, 6, 8, 10, 12, 14). The spring 17 exerts on the steering assembly 11, with respect to the rotation axis R, a torque C1 defined by the vector product between an elastic force F1 exerted by the spring 17 on the steering 11 and an arm B1 with respect to the rotation axis R (FIGS. 5, 7, 9, 11, 13, 15).

In particular, the force F1 has a direction defined by a straight line connecting the first point f1 and the second point f2 and an intensity defined by the product of an elastic constant of the spring 17 and the elongation thereof.

In use, the torque C1 acts on the rod 15 in such a manner as to maintain the contact wheel 16 pressed against the products during wrapping and to induce the steering assembly 11 to orient the directional wheels 9 according to a set work direction D (FIGS. 4 and 6) in which the carriage 2 is movable along a curved path, which is not shown, in a clockwise direction.

In particular, the torque C1 exerted by the spring 17 increases by steering the steering assembly 11 from the work direction D to a direction D1 (FIGS. 8, 10) in which the carriage 2 is movable along a rectilinear path, which is not shown, and decreases by steering the steering assembly 11 from the direction D1 to a further direction D2 (FIGS. 12, 14) in which the carriage 2 is movable along a further curved path, which is not shown, in a counterclockwise direction.

The wrapping machine 1 further includes a further spring 19 having an end pivoted in a third point f3 of the steering assembly 11 and a further end pivoted in a fourth point f4 of the frame 18 (FIGS. 4, 6, 8, 10, 12, 14).

Figure 5:
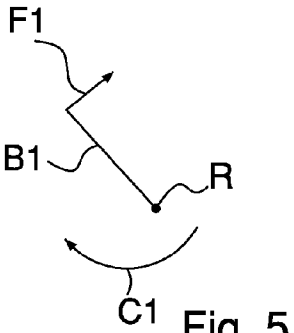
FIG. 5 is a vector diagram of the forces acting on the maneuvering assembly in FIG. 4.
Figure 9:
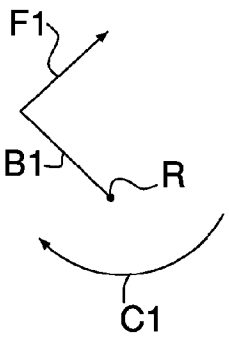
FIG. 9 is a vector diagram of the forces acting on the maneuvering assembly in FIG. 8.
Figure 13:
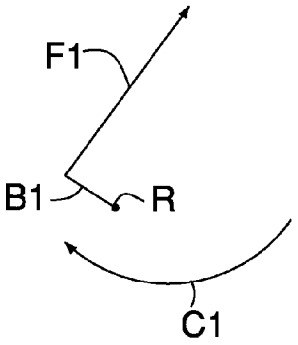
FIG. 13 is a vector diagram of the forces acting on the maneuvering assembly in FIG. 12.

In use, the steering assembly 11 drives the further spring 19 between a non-operating configuration NW (FIGS. 4, 8 and 12) and an operating configuration W (FIGS. 5, 9 and 13).

In particular, when the steering assembly 11 is raised into the work position L, the distance between the third point f3 and the fourth point f4 is such as not to cause any elongation of the further spring 19, which is thus in the non-operating configuration NW.

Figure 4:
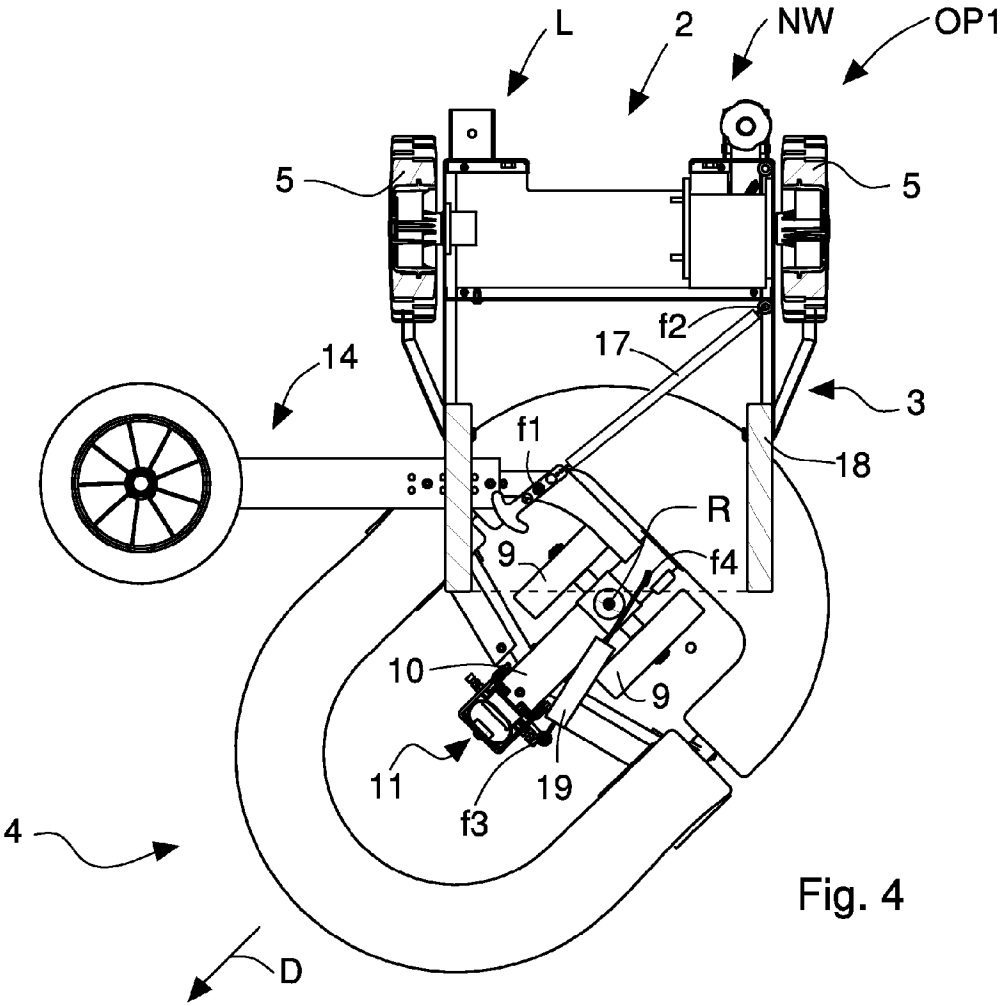
FIG. 4 is a section of the machine in FIG. 1 in which the maneuvering assembly is in the first operating position and directional wheels included in this machine are oriented in a first direction.
Figure 8:
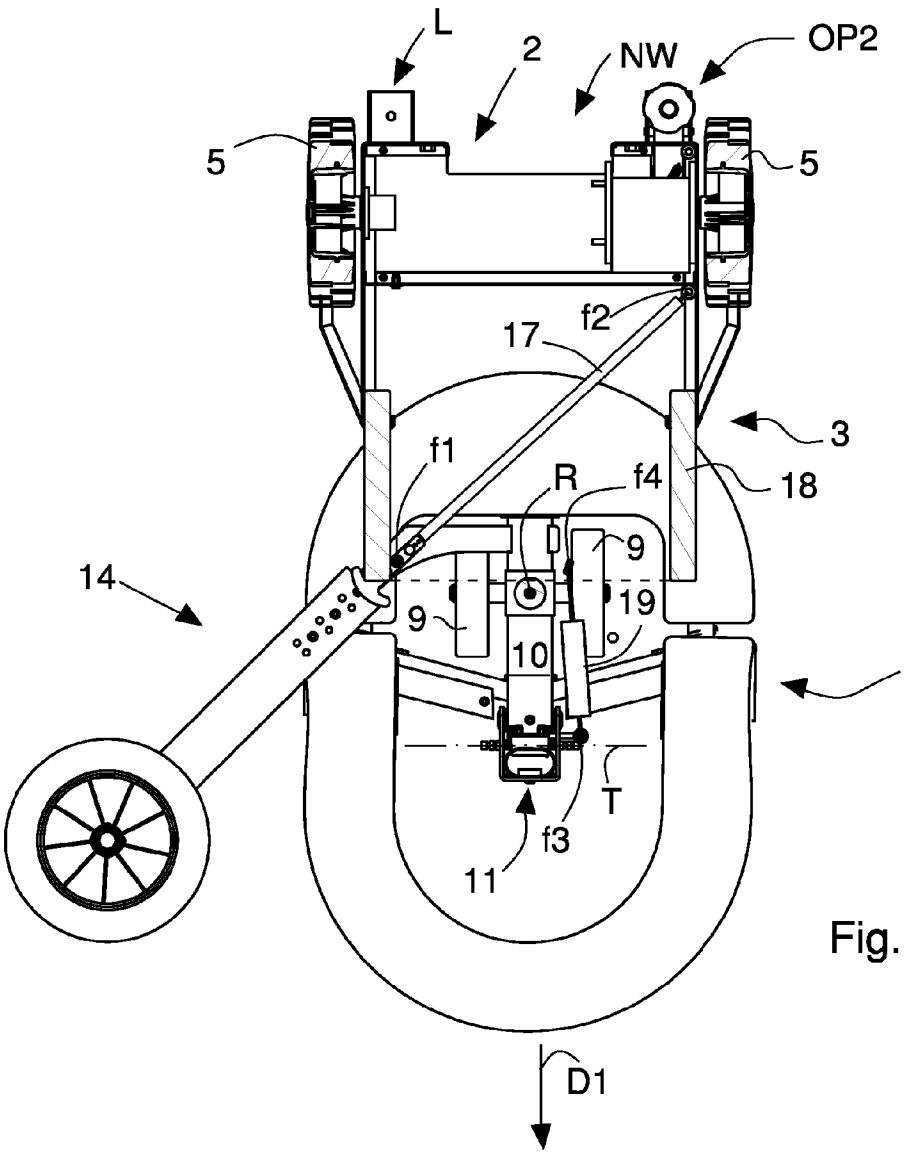
FIG. 8 is a section of the machine in FIG. 1 in which the maneuvering assembly is in the first operating position and the directional wheels are oriented in a second direction.
Figure 12:
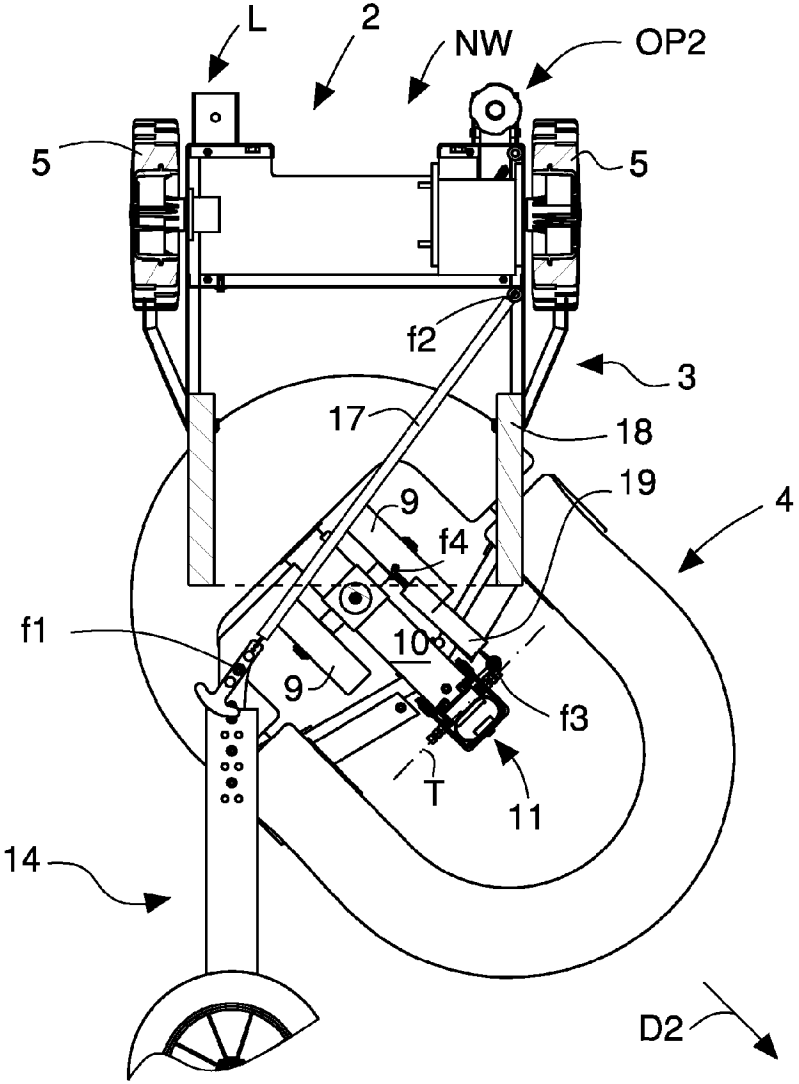
FIG. 12 is a section of the machine in FIG. 1 in which the maneuvering assembly is in the first operating position and the directional wheels are oriented in a third direction.
Figure 15:
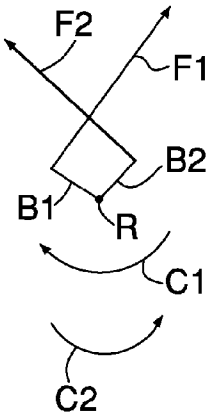
FIG. 15 is a vector diagram of the forces acting on the maneuvering assembly in FIG. 14.

This means that, in the non-operating configuration NW, the further spring 19 does not exert any torque on the steering assembly 11, with respect to the rotation axis R (FIGS. 4, 8, 12).

In one embodiment of the invention, which is not shown, the distance between the third point f3 and the fourth point f4, when the steering assembly 11 is raised into the work position L, is such as to cause only minimal elongation of the further spring 19. This means that, in the non-operating configuration NW of this embodiment, the further spring 19 exerts on the steering assembly 11, with respect to the rotation axis R, a further very small torque, in particular much less than the torque C1, such as not to be a hindrance to the automatic movement of the wrapping machine 1 during wrapping.

Conversely, when the steering assembly 11 is lowered into the maneuvering position M, it increases the distance between the third point f3 and the fourth point f4 to expand the further spring 19, which is thus in the operating configuration W (FIGS. 5, 9, 13).

In this operating configuration W, the further spring 19 exerts on the steering assembly 11, with respect to the rotation axis R, a further torque C2 determined by the vector product between a further elastic force F2 exerted by the further spring 19 on the steering assembly 11 and a further arm B2 of the further force F2 with respect to the rotation axis R (FIGS. 5, 9, 13).

In particular, the further force F2 has a further direction defined by a further straight line connecting the third point f3 and the fourth point f4 and a further intensity defined by the product between a further elastic constant of the further spring 19 and the elongation thereof.

This further torque C2, opposite the torque C1, acts on the steering assembly 11 such as to contrast the torque C1 such as to promote the maneuverability of the steering assembly 11 (FIGS. 5, 9, 13).

In particular, the further spring 19 is configured in such a manner that the further torque C2 is greater than the torque C1 (FIGS. 6 and 7) during movement of the steering assembly 11 from the work direction D to the direction D1, such that when the steering assembly 11 is in the maneuvering position M it is induced to orient the directional wheels 9 in the direction D1; such that the further torque C2 is substantially the same as, i.e. balances, the torque C1 when the steering 11 orients the directional wheels in the direction D1 (FIGS. 10 and 11) the further torque C2 is less than torque C1 during movement of the steering assembly 11 from the direction D1 to the further direction D2 (FIGS. 14 and 15) such that when the steering assembly 11 is in the maneuvering position M it is induced to orient the directional wheels 9 in the direction D1.

The wrapping machine 1 further includes a locking system, which is not shown, to lock the steering assembly 11 in the maneuvering position M so as to maintain the further spring 19 in the operating configuration W.

In one embodiment of the invention, which is not shown, the further spring 19 acts below the rotation axis T of the steering assembly 11, this enabling, in the operating configuration W, the steering assembly 11 to be maintained in the maneuvering position M.

The operation of the further spring 19 is disclosed in greater detail with reference to FIGS. 4 to 15.

Figure 6:
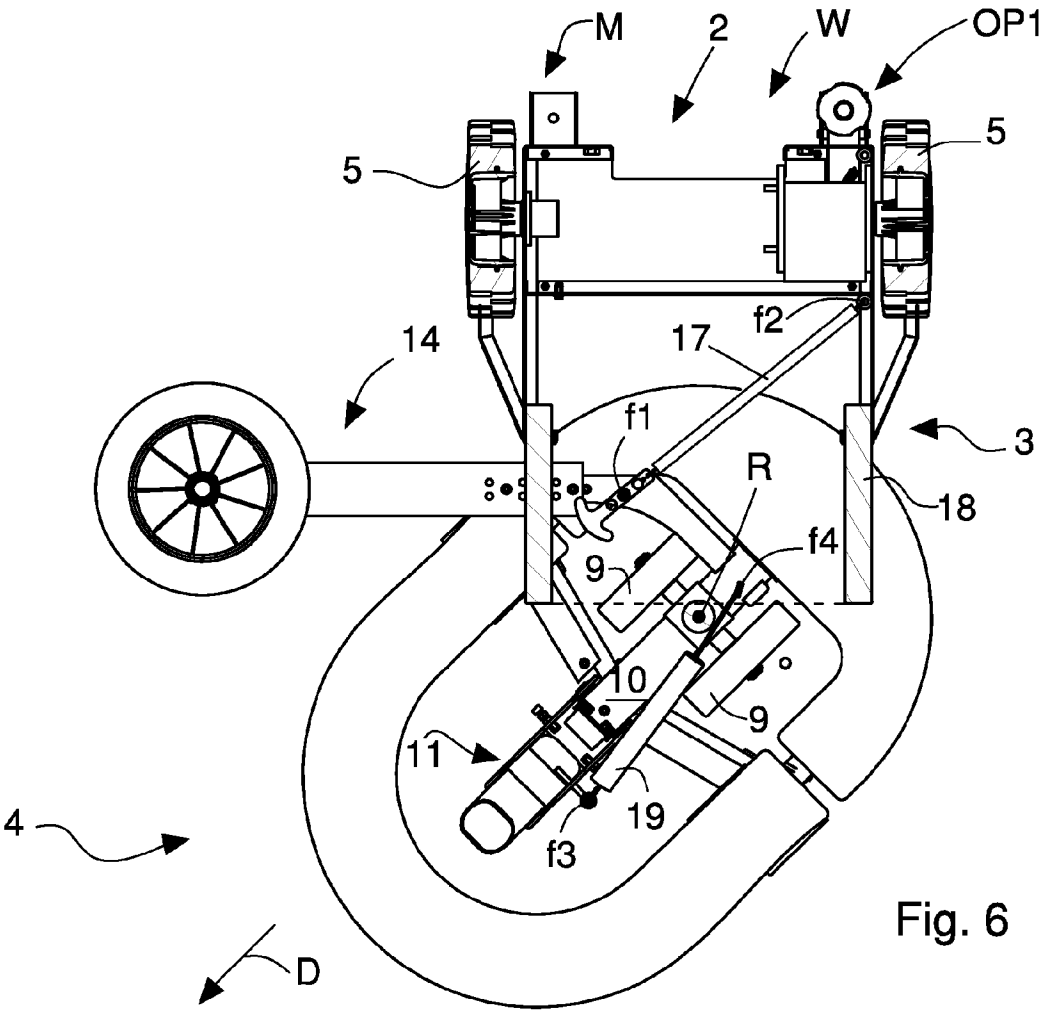
FIG. 6 is a section of the machine in FIG. 1 in which the maneuvering assembly is in the second operating position and the directional wheels are oriented in the first direction.

In FIGS. 4 and 6 the directional wheels 9 are shown in a first operating condition OP1 in which they are oriented in the work direction D to move the carriage 2 along the aforesaid curved path in a clockwise direction.

In the first operating condition OP1, when the steering assembly 11 is in the work position L and so the further spring 19 is in the non-operating configuration NW (FIG. 4), on the steering assembly 11 only the torque C1 acts that is exerted by the spring 17 that induces the steering assembly 11 to maintain the directional wheels 9 oriented in the work direction D (FIG. 5).

Figure 7:
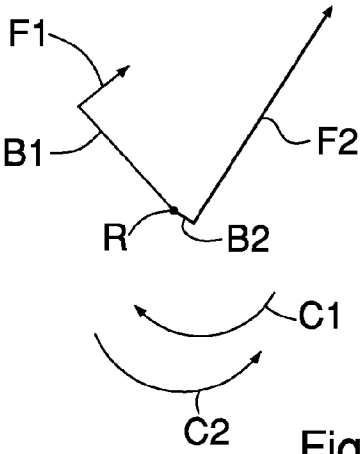
FIG. 7 is a vector diagram of the forces acting on the maneuvering assembly in FIG. 6.

Conversely, when the steering assembly 11 is in the maneuvering position M and thus the further spring 19 is in the operating configuration W (FIG. 6), both the torque C1 exerted by the spring 17 and the further torque C2, opposite the torque C1, exerted by the further spring 19 act on the steering assembly 11 (FIG. 7).

The further torque C2, by contrasting the torque C1, enables the steering 11 to be steered easily with respect to the work direction D.

As set forth above, in the first operating condition OP1, the further torque C2 is greater than the torque C1 to induce the steering assembly 11, maintained in the manoeuvring position M and without the intervention of an operator, to orient the directional wheels 9 in the direction D1.

Figures 10, 11:
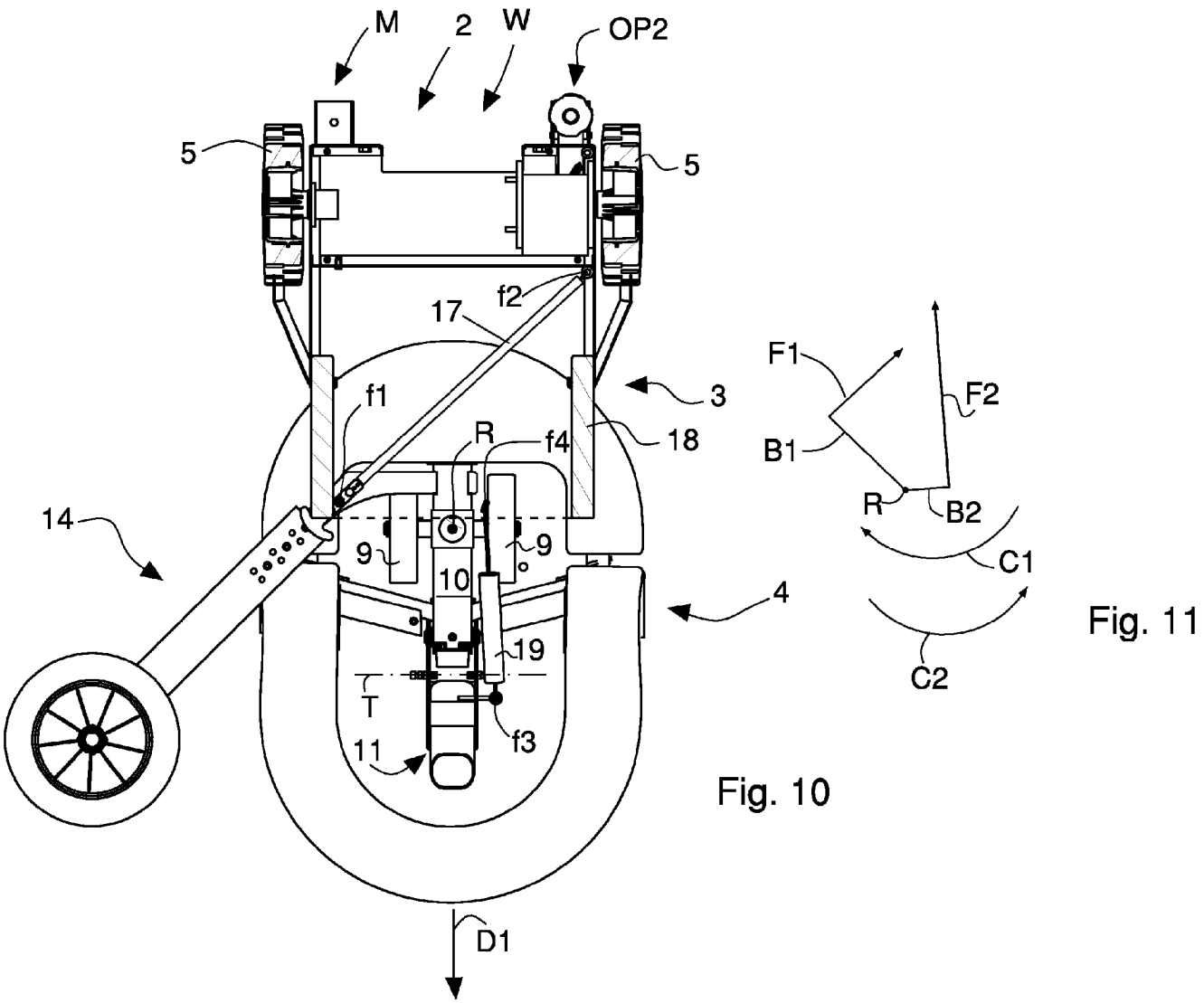
FIG. 10 is a section of the machine in FIG. 1 in which the maneuvering assembly is in the second operating position and the directional wheels are oriented in the second direction.
FIG. 11 is a vector diagram of the forces acting on the manoeuvring means in FIG. 10.

In FIGS. 8 and 10 the directional wheels 9 are shown in a second operating condition OP2 in which they are oriented in the direction D1 to move the carriage 2 along the aforesaid rectilinear path.

In the second operating condition OP2, when the steering assembly 11 is in the work position L and thus the further spring 19 is in the non-operating configuration NW (FIG. 8), only the torque C1 acts on the steering assembly 11, which torque C1 is exerted by the spring 17 that induces the steering assembly 11 to orient the directional wheels 9 in the work direction D (FIG. 9).

Conversely, when the steering assembly 11 is in the maneuvering position M and thus the further spring 19 is in the operating configuration W (FIG. 10), both the torque C1 exerted by the spring 17 and the further torque C2, opposite the torque C1, exerted by the further spring 19 (FIG. 11) act on the steering assembly 11.

As in the second operating condition OP2, the further torque C2 is substantially the same as, i.e. substantially balances, the torque C1, the steering assembly 11 is induced to maintain the directional wheels 9 oriented in the direction D1, without the operator exerting any torque on the steering assembly 11.

Figure 14:
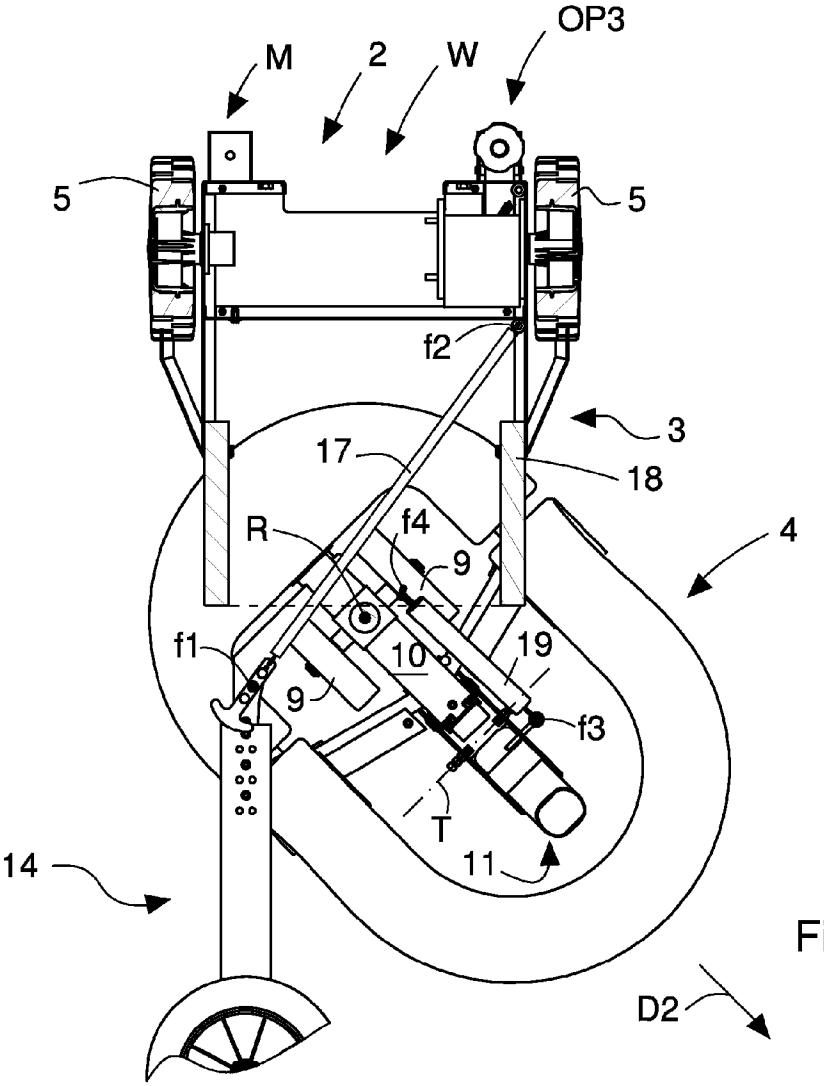
FIG. 14 is a section of the machine in FIG. 1 in which the maneuvering assembly is in the second operating position and the directional wheels are oriented in the third direction.
Figure 16:
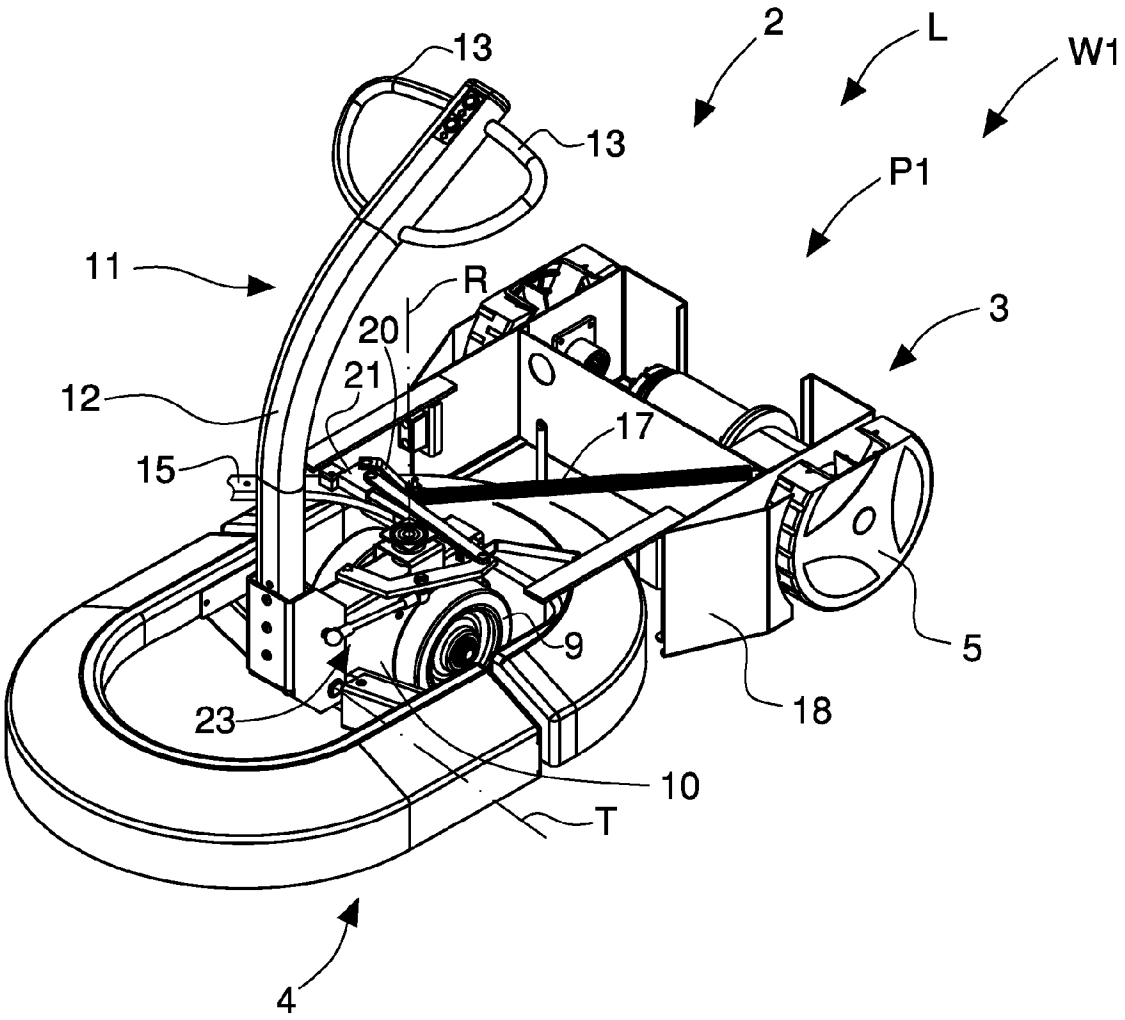
FIG. 16 is a perspective view of a further embodiment of the machine in FIG. 1 with certain details removed and showing the maneuvering assembly in a first operating position.
Figure 17:
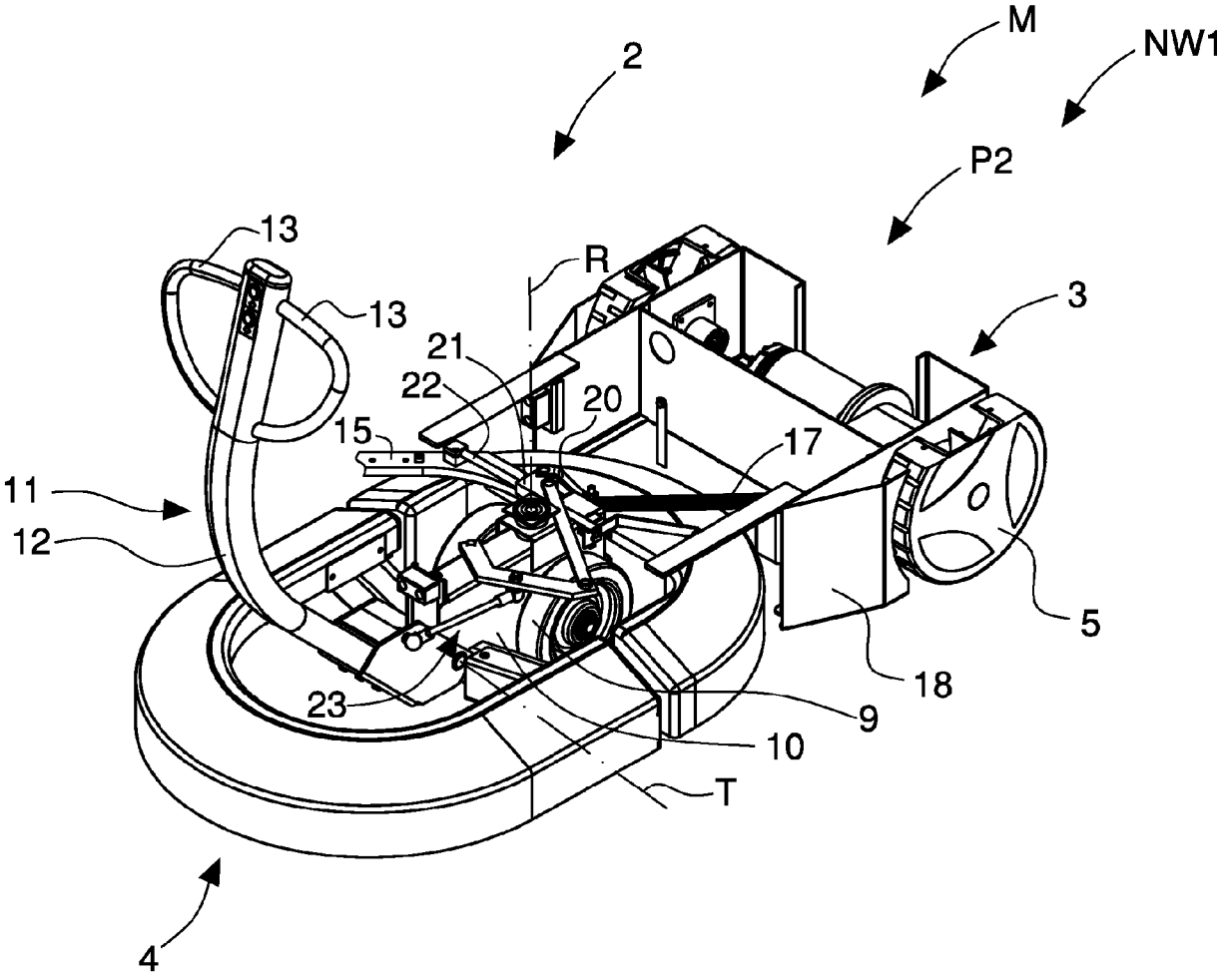
FIG. 17 is a perspective view of the further embodiment of the machine in FIG. 1 with certain details removed and showing the maneuvering assembly in a second operating position.

In FIGS. 12 and 14 there are shown the directional wheels 9 in a third operating condition OP3 in which they are oriented in the further direction D2 to move the carriage 2 along the further curved path in a counterclockwise direction.

In the third operating condition OP3, when the steering 11 is in the work position L and thus the further spring 19 is in the non-operating configuration NW (FIG. 12), on the steering assembly 11 only the torque C1 acts that is exerted by the spring 17 that induces the steering assembly 11 to orient the directional wheels 9 oriented in the work direction D (FIG. 13).

Conversely, when the steering assembly 11 is in the maneuvering position M and thus the further spring 19 is in the operating configuration W (FIG. 14), both the torque C1 exerted by the spring 17 and the further torque C2, opposite the torque C1, exerted by the further spring 19 (FIG. 15) act on the steering assembly 11.

The further torque C2, by contrasting the torque C1, enables the steering assembly 11 to be steered easily with respect to the further direction D2.

As set forth above, in the third operating condition OP3, the further torque C2 is less than the torque C1, to induce the steering assembly 11, maintained in the maneuvering position M and without the invention of an operator, to orient the directional wheels 9 in the direction D1.

In use, for wrapping the products placed on a pallet, an operator positions the steering assembly 11 in the maneuvering position M and places the carriage 2 near the pallet.

Subsequently, the operator positions the steering assembly 11 in the work position L, in which the further spring 19 is in the non-operating configuration NW, and activates the wrapping program.

At this point, the carriage 2 starts to automatically rotate around the pallet following the profile of the pallet by the mechanical feeler 14.

The combination of the motion of the self-propelled carriage 2 around the pallet and of the vertical motion of the reel achieves helical wrapping of the products.

After wrapping has terminated, the operator repositions the steering assembly 11 in the maneuvering position M, in which the further spring 19 is in the operating configuration W, and maneuvering the wrapping machine 1 towards another pallet of products to be wrapped.

It should be noted how, owing to the invention, it is possible to provide a self-propelled wrapping machine 1 that is easier for an operator to maneuvering than are known self-propelled wrapping machines.

In fact, the operator, by manually moving the steering assembly 11 from the work position L into the maneuvering position M, drives the further spring 19 to the operating configuration W in which the further spring 19, by acting on the steering assembly 11 in contrast with the spring 17, lightens the steering 11, and thus the guide body 4, facilitating the maneuverability thereof.

In one embodiment of the invention, which is not shown, instead of the further spring 19 a mechanical or pneumatic or hydraulic actuator is provided that is drivable, as disclosed for the further spring 19, by the steering assembly 11.

With reference to FIGS. 16 to 29 a further embodiment of the wrapping machine 1 is shown.

In this further embodiment, the spring 17 has an end pivoted in a point g1 of a bracket 20 and a further end pivoted in a further point g2, substantially coinciding with the second point f2, of the frame 18 of the supporting body 3 (FIGS. 18, 20, 22, 24, 26, 28).

In this further embodiment, the spring 17 exerts on the steering assembly 11, with respect to the rotation axis R, a first torque T1 defined by the vector product between a first elastic force Z1 exerted by the spring 17 on the steering 11 and a first arm A1 of the first force Z1 with respect to the rotation axis R (FIGS. 19, 21, 23, 25, 27, 29).

Figure 18:
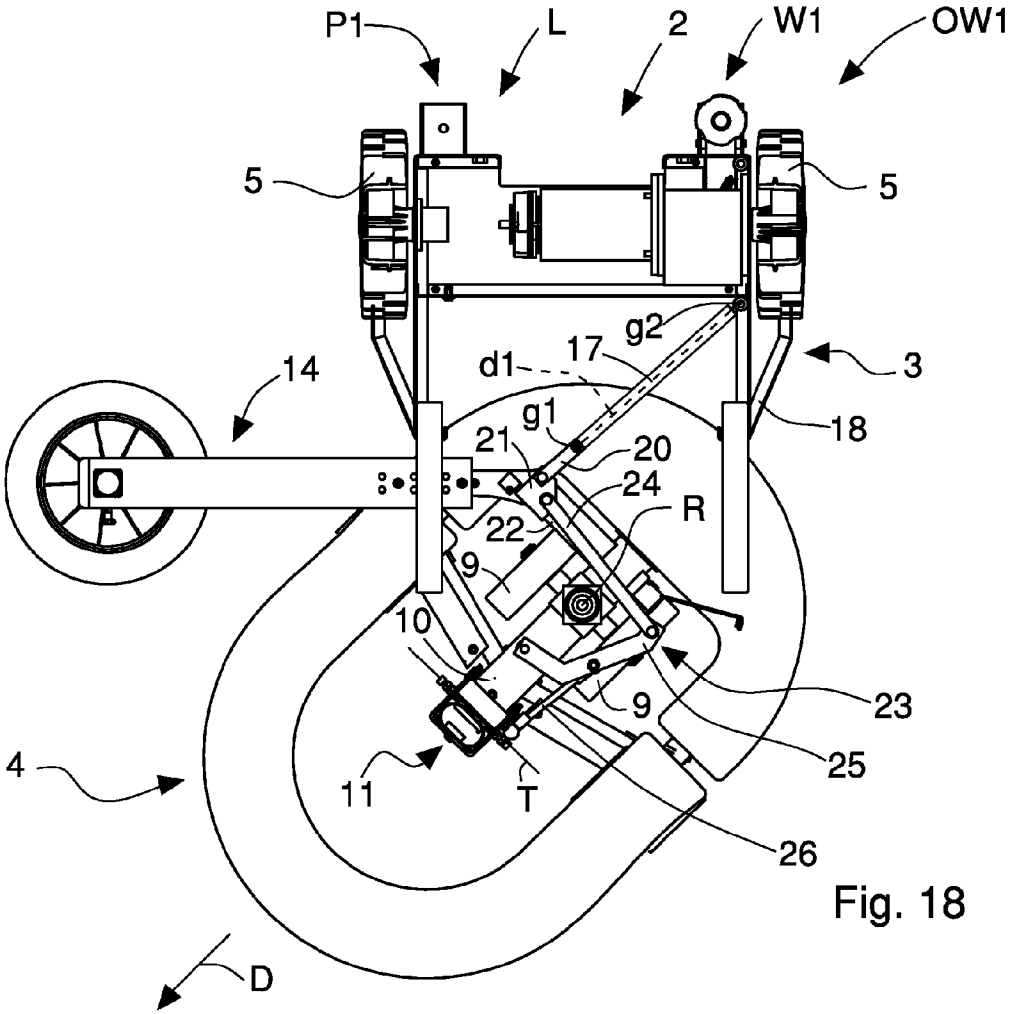
FIG. 18 is a section of the further embodiment of the machine in FIG. 1 in which the maneuvering assembly is in the first operating position and directional wheels included in this machine are oriented in a first direction.
Figure 22:
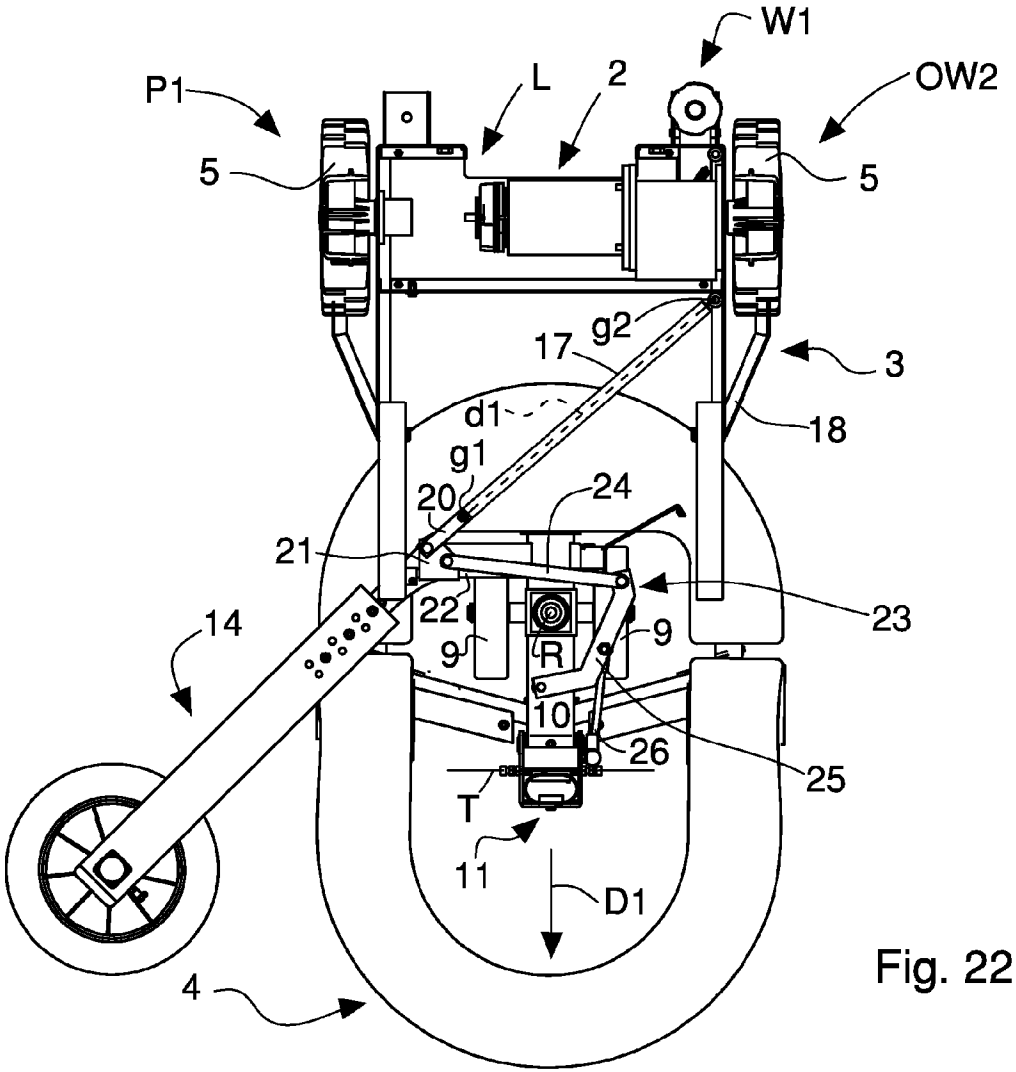
FIG. 22 is a section of the further embodiment of the machine in FIG. 1 in which the maneuvering assembly is in the first operating position and the directional wheels are oriented in a second direction.
Figure 26:
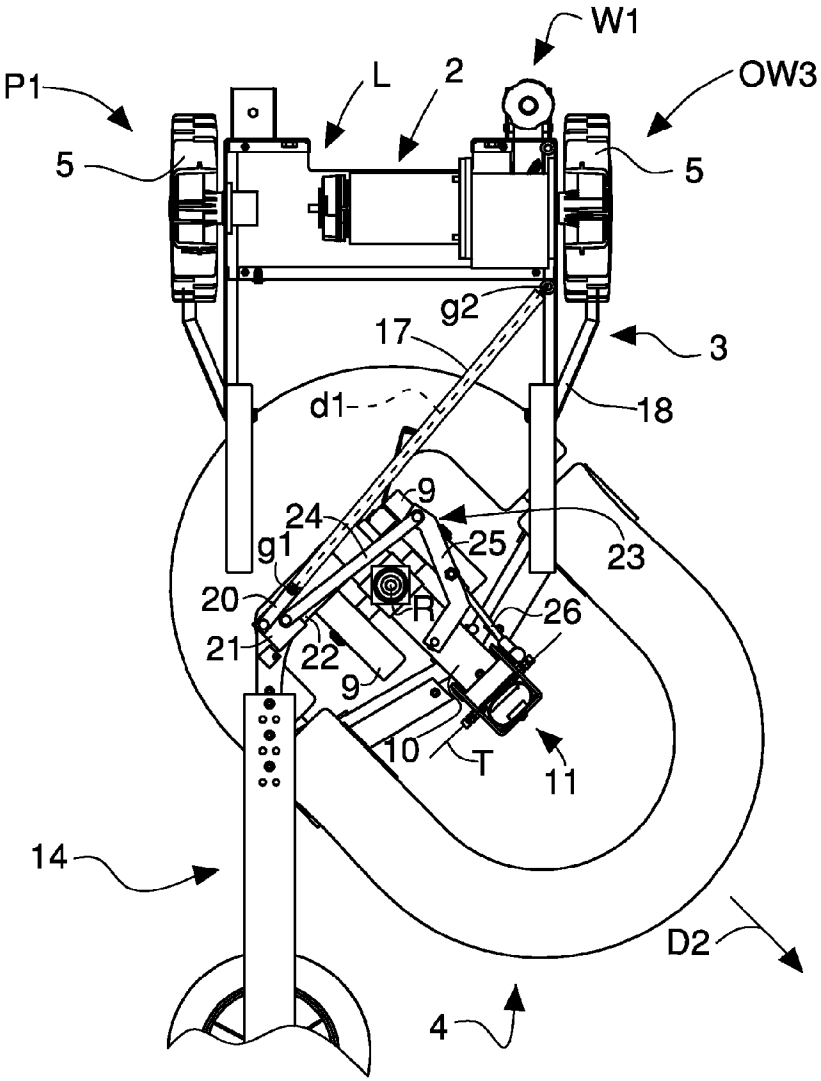
FIG. 26 is a section of the further embodiment of the machine in FIG. 1 in which the maneuvering assembly is in the first operating position and the directional wheels are oriented in a third direction.

In particular, the first force Z1 has an application direction d1, represented by a dashed line in FIGS. 18, 22, 26, defined by a straight line joining the point g1 and the further point g2 and an intensity defined by the product between an elastic constant of the spring 17 and the elongation thereof.

In use, the first torque T1 acts on the rod 15 in order to so maintain the contact wheel 16 pressed against the products during wrapping and to induce the steering assembly 11 to orient the directional wheels 9 according to the work direction D (FIGS. 18 and 20) in which the carriage 2 is movable along a curved path, which is not shown, in a clockwise direction.

In particular, the first torque T1 exerted by the spring 17 increases by steering the steering assembly 11 from the work direction D to the direction D1 (FIGS. 22, 24) in which the carriage 2 is movable along a rectilinear path, which is not shown, and decreases by steering the steering assembly 11 from the direction D1 to the further direction D2 (FIGS. 26, 28) in which the carriage 2 is movable along a further curved path, which is not shown, in a counterclockwise direction.

In this further embodiment, the wrapping machine 1 further comprises a slide 21 that is slidable along a guide 22, for example a rectilinear guide (FIGS. 16, 17, 18, 20, 22, 24, 26 and 28).

The guide 22 is connected on the one side to an end of the rod 15 opposite the end supporting the contact wheel 16, and on the other to the support 10.

The bracket 20 and an articulated arm 23 are rotatably connected to the slide 21.

The articulated arm 23 includes a first rod 24, a second rod 25 and a third rod 26.

In particular, the first rod 24, which is, for example, rectilinear, has an end that is rotatably connected to the slide 21 and a further end that is connected to the second rod 25.

The second rod 25 has a free end that is rotatably connected to the support 10 and an intermediate portion that is rotatably connected to the third rod 26.

Finally, the latter has a free end that is rotatably connected to the steering assembly 11.

In this further embodiment, the steering assembly 11 drives the spring 17, by the slide 21 moved by the articulated arm 23 connected to the steering assembly 11, between a first operating configuration W1 (FIGS. 16, 18, 22 and 26) and a first non-operating configuration NW1 (FIGS. 17, 19, 23 and 27).

In particular, by driving the steering assembly 11 between the first operating configuration W1 and the first non-operating configuration W1, the first torque T1 is reduced, inasmuch as the orientation of the application direction of the force exerted by the spring 17 is varied, which reduces the arm of this force, and/or the distance decreases between the point g1 and the further point g2, which reduces the elongation, and thus the intensity, of this force.

In the first operating configuration W1, the steering assembly 11 is raised into the work position L and the slide 21, driven by the steering assembly 11 by the articulated arm 23, is in a first position P1 (FIGS. 16, 18, 22, 26).

Figure 19:
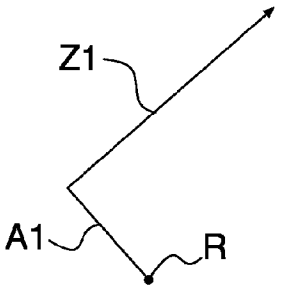
FIG. 19 is a vector diagram of the force and of the torque acting on the maneuvering assembly in FIG. 18.
Figure 23:
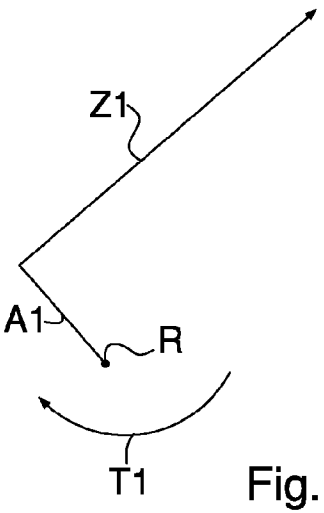
FIG. 23 is a vector diagram of the force and of the torque acting on maneuvering assembly in FIG. 22.
Figure 27:
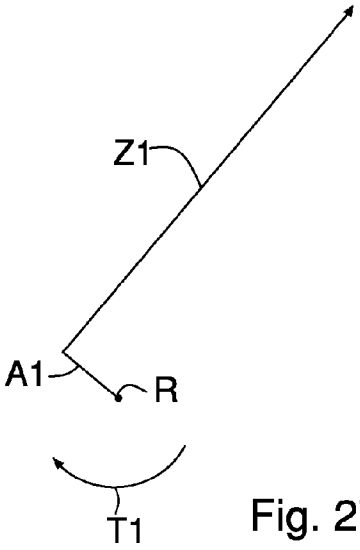
FIG. 27 is a vector diagram of the force and of the torque acting on the maneuvering assembly in FIG. 26.

In the first operating configuration W1, the spring 17 exerts on the steering assembly 11, with respect to the rotation axis R, the first torque T1 (FIGS. 19, 23, 27).

Figure 29:
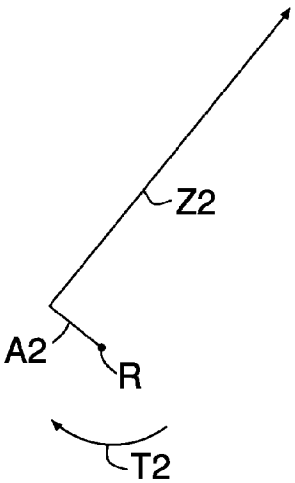
FIG. 29 is a vector diagram of the force and of the torque acting on the maneuvering assembly in FIG. 28.

In the first non-operating configuration NW1, the steering assembly 11 is lowered into the maneuvered position M and the slide 21, driven by the steering assembly 11 by the articulated arm 23, is in a second position P2 (FIGS. 17, 20, 24, 28). In the first non-operating configuration NW1, the spring 17 exerts on the steering assembly 11, with respect to the rotation axis R, a second torque T2, that is less than the first torque T1, determined by the vector product between a second elastic force Z2 exerted by the spring 17 on the steering assembly 11 and a second arm A2 of the second force Z2 with respect to the rotation axis R (FIGS. 21, 25, 29).

Figures 20, 21:
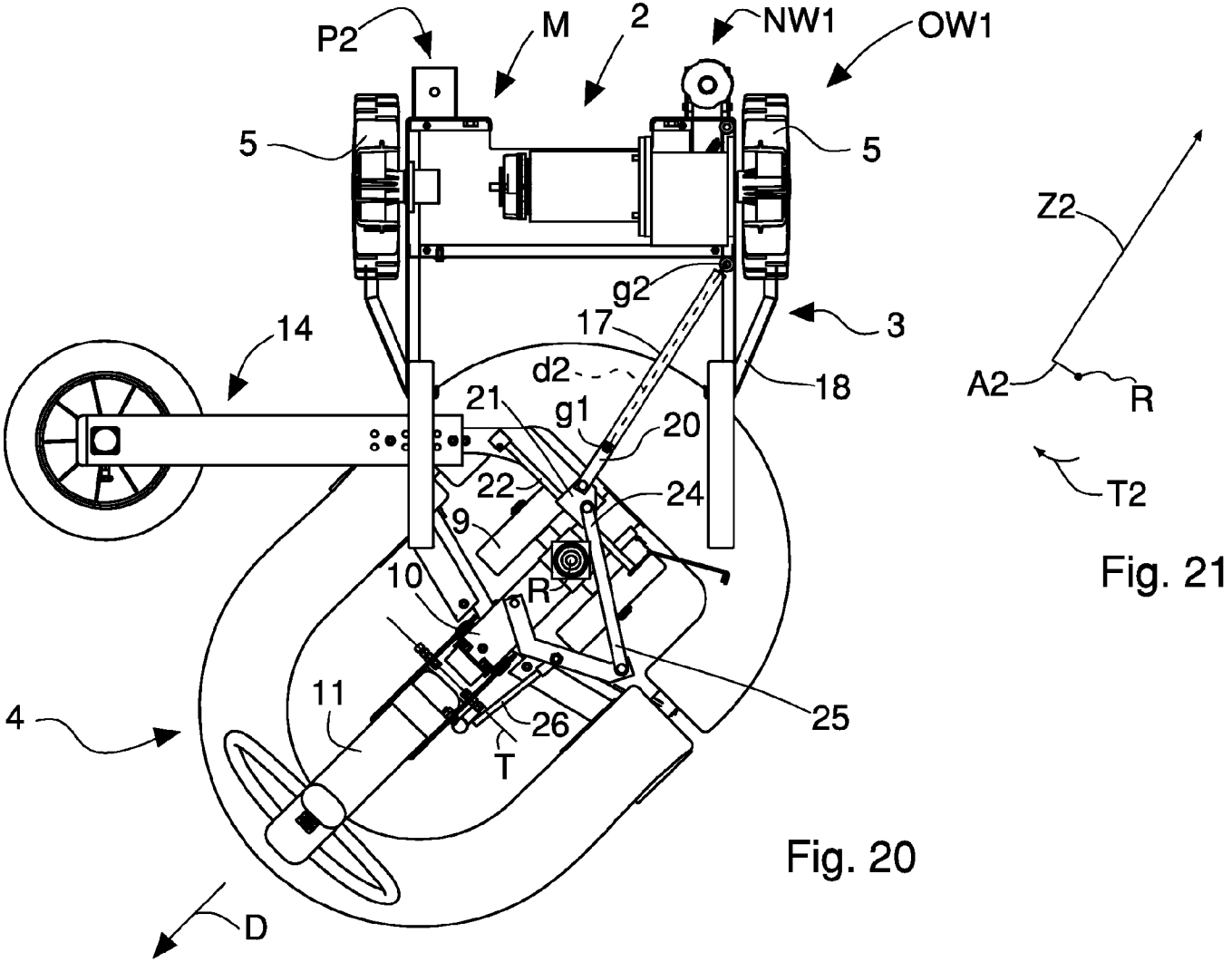
FIG. 20 is a section of the further embodiment of the machine in FIG. 1 in which the maneuvering assembly is in the second operating position and the directional wheels are oriented in the first direction.
FIG. 21 is a vector diagram of the force and of the torque acting on the maneuvering assembly in FIG. 20.
Figures 24, 25:
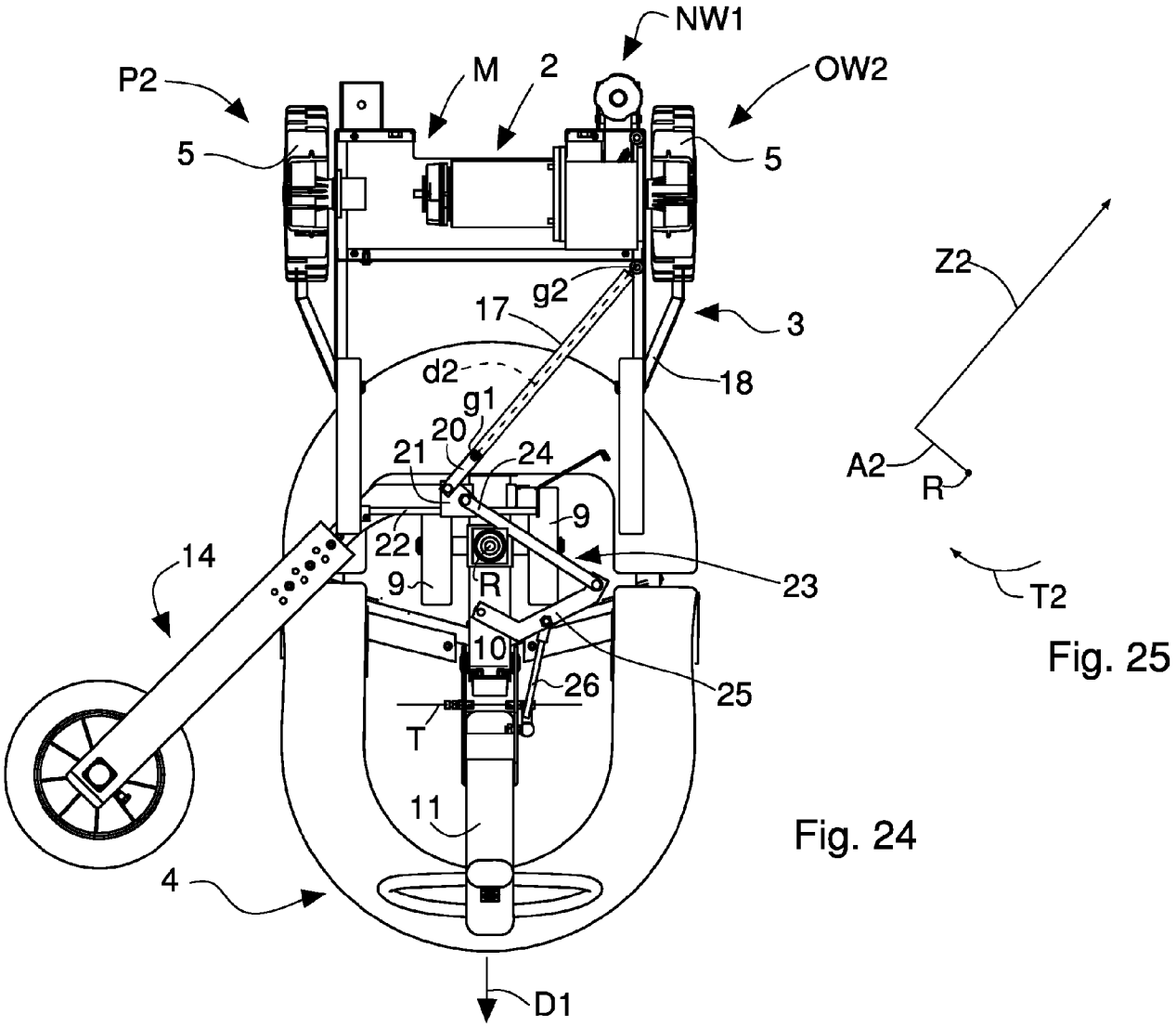
FIG. 24 is a section of the further embodiment of the machine in FIG. 1 in which the maneuvering assembly is in the second operating position and the directional wheels are oriented in the second direction.
FIG. 25 is a vector diagram of the torque and of the torque acting on the maneuvering assembly in FIG. 24.
Figure 28:
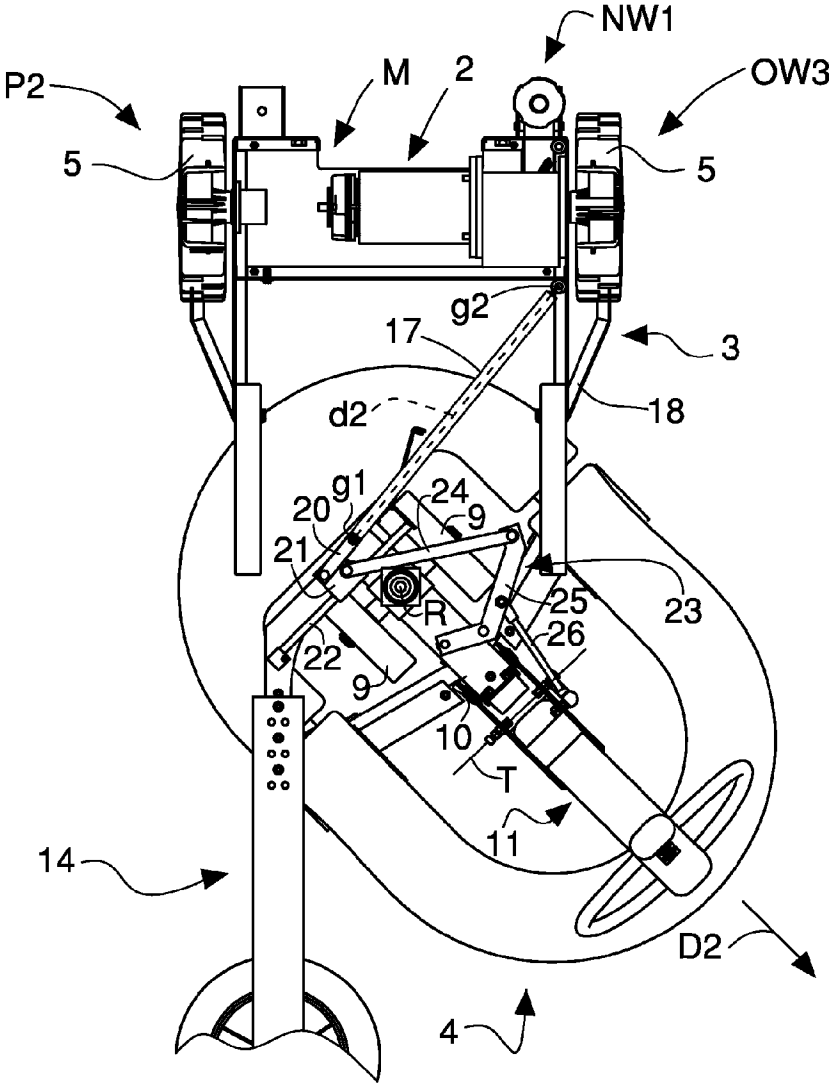
FIG. 28 is a section of the further embodiment of the machine in FIG. 1 in which the maneuvering assembly is in the second operating position and the directional wheels are oriented in the third direction.

In particular, the second force Z2 has a further application direction d2, represented by a dashed line in FIGS. 20, 24, 28, defined by a further straight line joining point g1 with the further point g2 and a further intensity defined by the product between a further elastic constant of the spring 17 and the elongation thereof.

This second torque T2, which is less than the first torque T1, makes it easier for an operator to maneuver the steering 11.

Also in this further embodiment, the wrapping machine 1 includes a locking system, which is not shown, for locking the steering assembly 11 in the maneuvering position M so as to maintain the spring 17 in the first non-operating configuration NW1.

The operation of this further embodiment is disclosed in greater detail with reference to FIGS. 18 to 29.

In FIGS. 18 and 20 there are shown the directional wheels 9 in a further first operating condition OW1 in which they are oriented in the work direction D to move the carriage 2 along the aforesaid curved path in a clockwise direction.

In the further first operating condition OW1, when the steering assembly 11 is in the work position L and thus the spring 17 is in the first operating configuration W1 (FIG. 18), the first torque T1 that is exerted by the spring 17 that the steering assembly 11 to maintain the directional wheels 9 oriented in the work direction D is (FIG. 19).

Conversely, when the steering assembly 11 is in the maneuvering position M and thus the spring 17 is in the first non-operating configuration NW1 (FIG. 20), the second torque T2 acts on the steering assembly 11. This second torque T2 is less than the first torque T1 inasmuch as the second arm A2 is less than the first arm A1.

The second torque T2, which is less than the first torque T1, enables the steering assembly 11 to be steered more easily with respect to the work direction D.

In the further first operating condition OW1, the second torque T2 induces the steering 11, maintained in the maneuvering position M and without the intervention of an operator, to orient the directional wheels 9 in the work direction D.

In FIGS. 22 and 24 the directional wheels 9 are shown in a further second operating condition OW2 in which they are oriented in the direction D1 to move the carriage 2 along the aforesaid rectilinear path.

In the further second operating condition OW2, when the steering assembly 11 is in the work position L and thus the spring 17 is in the first operating configuration W1 (FIG. 22), the first torque T1 exerted by the spring 17 induces the steering assembly 11 to orient the directional wheels 9 according to the work direction D (FIG. 23).

Conversely, when the steering assembly 11 is in the maneuvering position M and thus the spring 17 is in the first non-operating configuration NW1 (FIG. 24), the second torque T2 acts on the steering assembly 11. This second torque T2 is less than the first torque T1 inasmuch as the second arm A2 is less than the first arm A1 and the second force Z2 is less than the first force Z1.

The second torque T2, which is less than the first torque T1, enables the steering assembly 11 to be steered more easily with respect to the work direction D.

In the further second operating condition OW2, the second torque T2 induces the steering assembly 11, maintained in the maneuvering position M and without the intervention of an operator, to orient the directional wheels 9 according to the work direction D.

In FIGS. 26 and 28 the directional wheels 9 are shown in a further third operating condition OW3 in which they are oriented in the further direction D2 to move the carriage 2 along the further curved path in a counterclockwise direction.

In the further third operating condition OW3, when the steering assembly 11 is in the work position L and thus the spring 17 is in the first operating configuration W1 (FIG. 26), the first torque T1 exerted by the spring 17 induces the steering 11 to orient the directional wheels 9 in the work direction D (FIG. 27).

Conversely, when the steering assembly 11 is in the maneuvering position M and thus the spring 17 is in the first non-operating configuration NW1 (FIG. 28), the second torque T2 acts on the steering assembly 11. This second torque T2 is less than the first torque T1 inasmuch as the second arm A2 is less than the first arm A1 and the second force Z2 is less than the first force ZS1.

The second torque T2, which is less than the first torque T1, enables the steering assembly 11 to be steered more easily with respect to the work direction D.

In the further third operating condition OW3, the second torque T2 induces the steering 11, maintained in the assembly position M and without the intervention of an operator, to orient the directional wheels 9 in the work direction D.

In use, for wrapping the products placed on a pallet, an operator positions the steering assembly 11 in the maneuvering position M and places the carriage 2 near the pallet.

Subsequently, the operator positions the steering assembly 11 in the work position L, in which the further spring 19 is in the first operating configuration W1, and activates the wrapping program.

At this point, the carriage 2 starts to rotate automatically around the pallet following the profile of the pallet by the mechanical feeler 14.

The combination of the motion of the self-propelled carriage 2 around the pallet and of the vertical motion of the reel achieves helical wrapping of the products.

After wrapping has terminated, the operator repositions the steering assembly 11 in the maneuvering position M, in which the spring 17 is in the first non-operating configuration NW1, and maneuvers the wrapping machine 1 towards another pallet of products to be wrapped.

It should be noted how, owing to the invention, it is possible to provide a self-propelled wrapping machine 1 that is easier for an operator to maneuver than known self-propelled wrapping machines.

In fact, by moving the steering assembly 11 manually from the work position L into the maneuvering position M, the operator drives, by the articulated arm 23 and the slide 21, the spring 17 into the first non-operating configuration NW1 in which the spring 17 exerts on the steering assembly 11 a second torque T2, which is less than the first torque T1, thus lightening the steering assembly 11 and facilitating the maneuvering thereof.

In one embodiment of the invention, which is not shown, the articulated arm 23 and the slide 21 are configured in such a manner that, in the first non-operating configuration NW1, the application direction of the force exerted by the spring 17 intersects the rotation axis R of the directional wheels.

In this manner the second arm A2 and thus the second torque T2 are cancelled.

In another embodiment of the invention, which is not shown, the articulated arm 23 and the slide 21 are configured in such a manner that, in the first non-operating configuration NW1, the distance between the point g1 and the further point g2 is such as not to cause any elongation of the spring 17.

In this manner the second force Z2 and thus the second torque T2 are cancelled.

In still another embodiment of the invention, which is not shown, the articulated arm 23 and the slide 21 are configured in such a manner that, in the first non-operating configuration NW1, the application direction of the force exerted by the spring 17 intersects the rotation axis R of the directional wheels and the distance between the point g1 and the further point g2 is such as not to cause any elongation of the spring 17. In this manner both the second arm A2 and the second force Z2 are cancelled, to cancel the second torque T2.

The invention claimed is:

1. A self-propelled wrapping machine that is movable around a product for wrapping said product with a film of synthetic plastic material, comprising (a) at least one directional wheel connected with said wrapping machine for rotation around a vertical rotation axis to enable said wrapping machine to follow a desired movement path;

(b) a steering assembly connected with said at least one directional wheel for steering said at least one directional wheel along said movement path;

(c) a spring connected with said steering assembly for exerting a first force along an application direction to generate a first torque on said steering assembly to induce said steering assembly to rotate said at least one directional wheel around said vertical rotation axis according to a set direction; and (d) an actuator assembly connected with said spring for displacing said spring between a first operating configuration wherein said spring exerts said first torque and a first non-operating configuration wherein said spring exerts a second torque less than said first torque.

2. A self-wrapping machine as defined in claim 1, wherein said actuator assembly is configured to change an orientation of said application direction between said first operating configuration and said first non-operating configuration in order to reduce a first segment of said first force with respect to said rotation axis.

3. A self-wrapping machine as defined in claim 1, wherein said application direction intersects said vertical rotation axis in said first non-operating configuration.

4. A self-wrapping machine as defined in claim 1, wherein said actuator assembly is configured to reduce an elongation of said spring between said first operating configuration and said first non-operating configuration.

5. A self-wrapping machine as defined in claim 1, wherein said actuator assembly is movable between a first operating position wherein it displaces said spring to said first operating configuration to enable the machine to wrap said product automatically and a second operating position wherein it displaces said spring to said first non-operating configuration to enable an operator to maneuver the machine manually.

6. A self-wrapping machine as defined in claim 1, wherein said actuator assembly includes said steering assembly.

7. A self-wrapping machine as defined in claim 1, wherein said actuator assembly further includes a slide connected with said steering assembly, one end of said spring being connected with said steering assembly via said slide.

8. A self-wrapping machine as defined in claim 7, wherein said slide is movable between a first position wherein said spring is in said first operating configuration and a second position wherein said spring is in said first non-operating configuration.

9. A self-wrapping machine as defined in claim 7, wherein said actuator assembly further includes a guide for slidably supporting said slide.

10. A self-wrapping machine as defined in claim 7, wherein said actuator assembly further includes an articulated arm connecting said slide with said steering assembly and drivable by said steering assembly.

* * * * *